US005993331A

United States Patent [19]

Shieh

[11] Patent Number: 5,993,331

[45] Date of Patent: Nov. 30, 1999

[54] STRUCTURE OF GOLF CLUB HEAD

[75] Inventor: Ji Shieh, Kaohsiung, Taiwan

[73] Assignee: Wuu Horng Industrial Co., Ltd., Kaohsiung, Taiwan

[21] Appl. No.: 09/121,619

[22] Filed: Jul. 22, 1998

[51] Int. Cl.[6] ..... A63B 53/04

[52] U.S. Cl. ..... 473/342; 473/345; 473/350

[58] Field of Search ..... 473/324, 334, 473/335, 336, 337, 338, 339, 349, 350, 342, 345, 346

[56] References Cited

U.S. PATENT DOCUMENTS 4,708,347 11/1987 Kobayashi .
4,984,800 1/1991 Hamada .
5,433,440 7/1995 Lin .
5,669,829 9/1997 Lin .
5,697,855 12/1997 Aizawa .
5,718,645 2/1998 Chang .
5,842,934 12/1998 Ezaki .

*Primary Examiner*—Sebastiano Passaniti
*Attorney, Agent, or Firm*—Pro-Techtor International Services

[57] ABSTRACT

A golf club head includes a face panel and a hollow casing directly molded from aluminum alloy on the face panel and covered over the border area of the face panel, wherein a weight is mounted in a back recess at the center of the back side wall of the face panel to concentrate the center of gravity of the face panel at the center area, a metal locating plate is welded to the back side wall of the face panel to fixedly secure the weight in place, and a plurality of V-shaped metal ribs are welded to the back side wall of the face panel and embedded in the aluminum alloy of the casing, the metal ribs each defining with the back side wall of the face panel a through hole, which is filled up by the aluminum alloy of the casing.

2 Claims, 5 Drawing Sheets

STRUCTURE OF GOLF CLUB HEAD

BACKGROUND OF THE INVENTION

The present invention relates to golf club head, and more particularly to an improved structure of golf club head which has a reinforced face panel mounted with a weight, which concentrates the center of gravity of the face panel at the center area.

A variety of golf clubs have been disclosed, and have appeared on the market. These golf clubs have different club heads made of different materials. FIG. I shows a golf club head according to the prior art. This structure of golf club head 10 is expensive because it is integrally molded from titanium alloy. FIG. 2 shows another structure of golf club head according to the prior art. The golf club head 10 shown in FIG. 2 is molded from aluminum alloy, having a front recess 101 and a titanium face panel 20 mounted in the front recess 101 and fixedly secured thereto by screws, rivets, glue, etc. This structure of golf club head is less expensive, however the face panel tends to vibrate or to fall from the body of the club head upon a high impact force.

SUMMARY OF THE INVENTION

It is one object of the present invention to provide a golf club head which has its center of gravity concentrated at the center area of the face panel thereof, enabling the user to drive the ball more easily. It is another object of the present invention to provide a golf club head enables the player to drive the ball farther. It is still another object of the present invention to provide a golf club head which has a reinforced face panel that does not crack with use. According to one aspect of the present invention, the golf club head comprises a face panel and a hollow casing directly molded from aluminum alloy on the face panel and covered over the border area of the face panel, wherein a weight is mounted in a back recess at the center of the back side wall of the face panel to concentrate the center of gravity of the face panel at the center area, and a metal locating plate is welded to the back side wall of the face panel to fixedly secure the weight in place. According to another aspect of the present invention, a plurality of V-shaped metal ribs are welded to the back side wall of the face panel and embedded in the aluminum alloy of the casing to reinforce the structural strength of the golf club head. The metal ribs each define with the back side wall of the face panel a through hole, which is filled up by the aluminum alloy of the casing.

DETAILED DESCRIPTION OF THE PREFERRED EMBODIMENT

Figure 1:
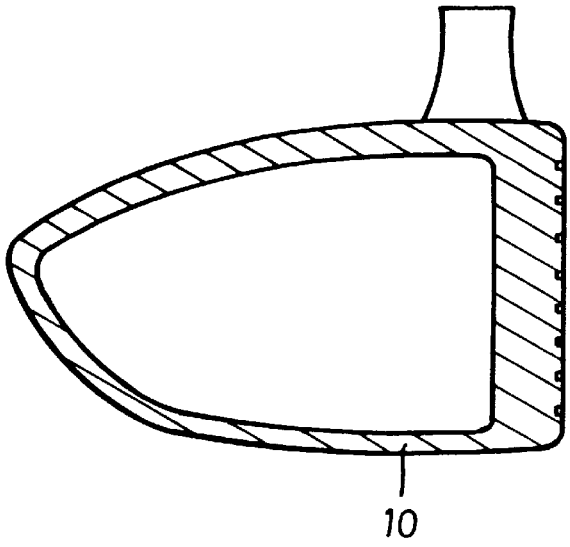
FIG. 1 (Prior Art)
FIG. 1 is a sectional view of a golf club head according to the prior art.
Figure 2:
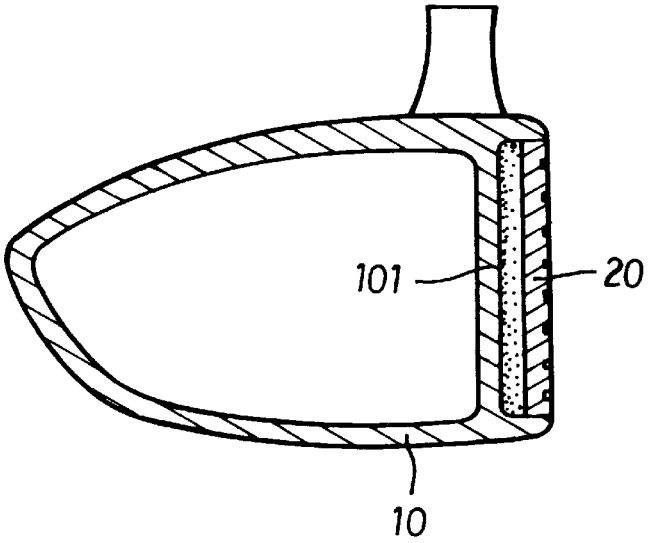
FIG. 2 (Prior Art)
FIG. 2 is a sectional view of another structure of golf club head according to the prior art.
Figure 3:
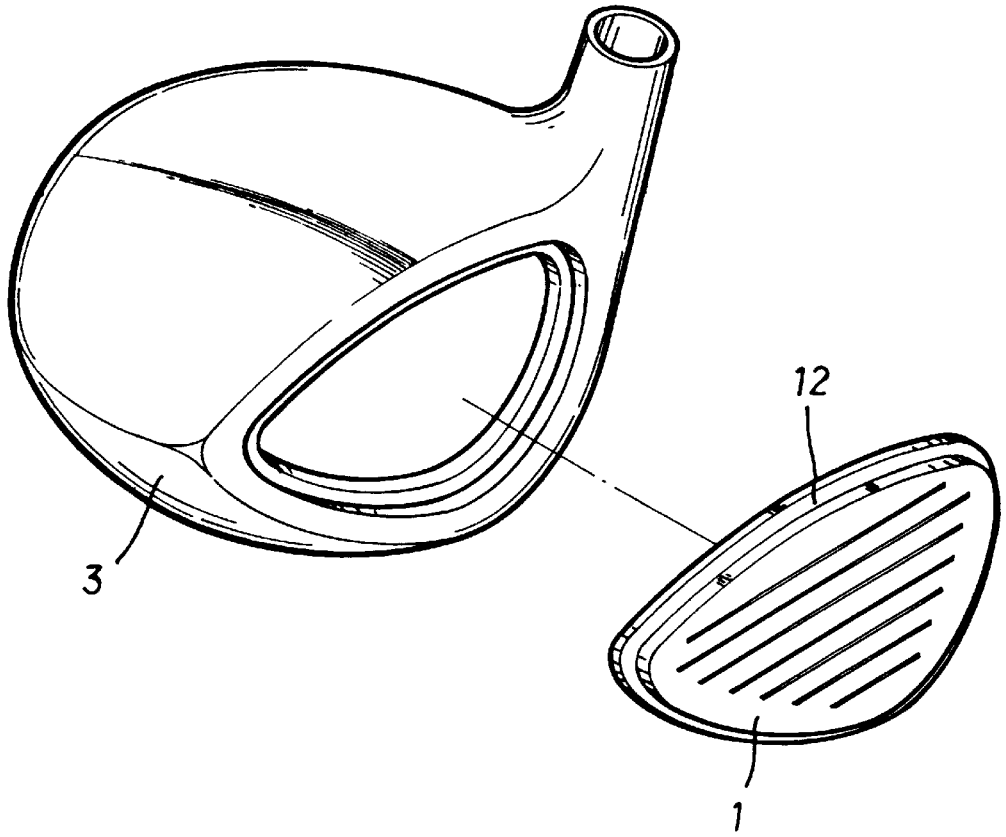
FIG. 3 is an exploded view of a golf club head according to the present invention.
Figure 4:
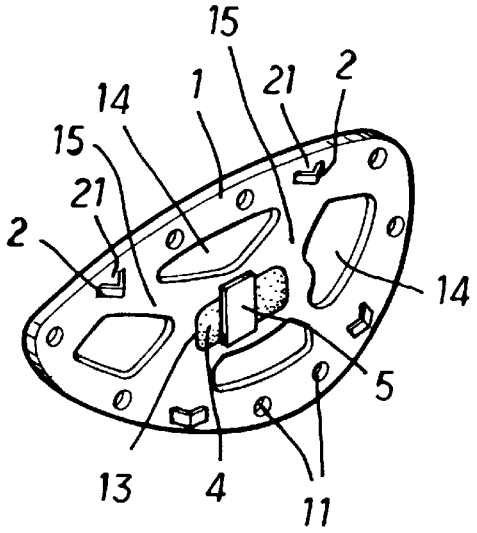
FIG. 4 is a back side view of the face panel shown in FIG. 3.
Figure 5:
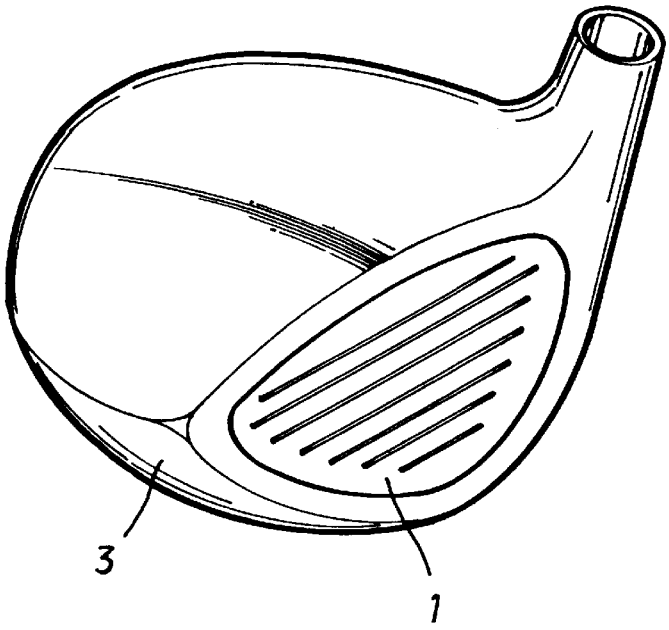
FIG. 5 is a perspective view of the golf club head according to the present invention.
Figure 6:
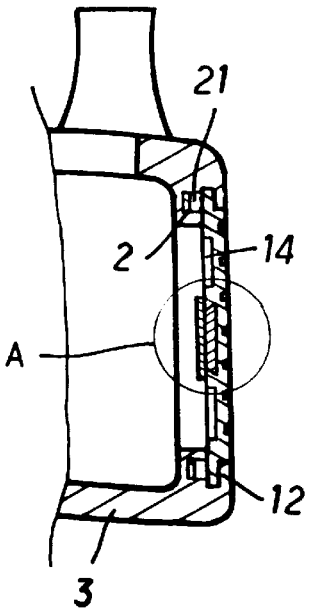
FIG. 6 is a sectional view of a part of the present invention, showing the face panel embedded within the casing.
Figure 6A:
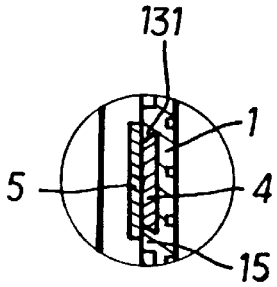
FIG. 6A is an enlarged view of part A of FIG. 6.

Referring to FIGS. 3, 4 and 5, a golf club head in accordance with the present invention is generally comprised of a hollow casing 3, and a face panel 1 provided at one side namely the front side of the casing 3.

Figure 7:
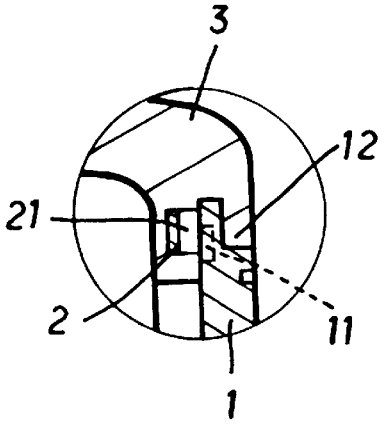
FIG. 7 is a sectional view in an enlarged scale of a part of the present invention.
Figure 8:
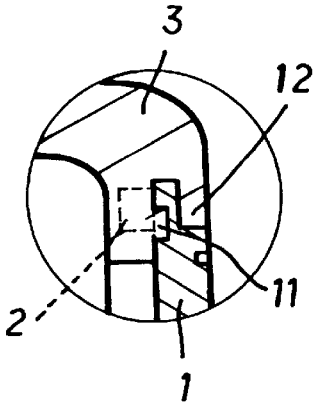
FIG. 8 is a sectional view in an enlarged scale of a part of the present invention.
Figure 9:
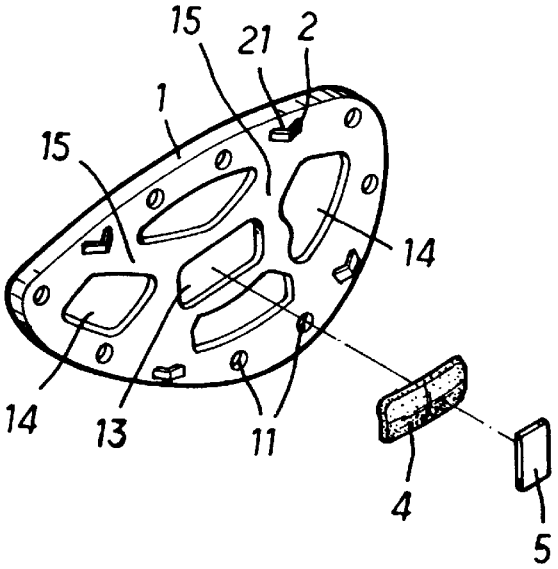
FIG. 9 is an exploded view of the face panel according to the present invention.
Figure 10:
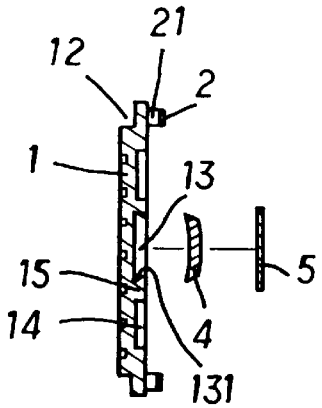
FIG. 10 is a sectional view of FIG. 9 taken from another angle.

Referring to FIGS. 7 and 8 and Figures from 3 through 5 again, the face panel 1 is made of metal plate by stamping, having a peripheral groove 12 at the front side wall thereof and a plurality of blind holes 11 at the back side wall thereof around the border area. A plurality of substantially V-shaped metal ribs 2 are respectively welded to the back side wall of the face panel 1 at the border area, each defining with the back side wall of the face panel 1 a through hole 21. The hollow aluminum alloy casing 3 is directly molded on the face panel 1 and covered over the peripheral groove 12, the blind holes 11, and the V-shaped metal ribs 2. During molding process, molten aluminum alloy fills up the through holes 21 in the V-shaped metal ribs 2, the blind holes 11 and the peripheral groove 12 of the face panel 1, and the front side of the face panel 1 is maintained in flush with the casing 3.

Referring to FIGS. 6, 6A, 9 and 10 and FIG. 4 again, within the back side wall of the face panel 1 outside the casing 3, there is provided a center recess 13 and a plurality of border recesses 14 spaced around the center recess 13. The border recesses 14 are separated from one another by thick wall portions 15 (see FIGS. 9 and 10). A weight 4 is mounted within the center recess 13. A locating metal plate 5 is welded to the back side wall of the face panel 1 to secure the weight 4 to the center recess 13 (see FIG. 4). A peripheral groove 131 is provided within the center recess 13 at the bottom. The weight 4 is a slightly arched metal plate of high extensibility (see FIG. 10). When the weight 4 is inserted into the center recess 13, a downward striking force is given to the weight 4 against the face panel 1, causing the weight 4 to extend peripherally outwards and to fill up the peripheral groove 131 in the center recess 13, and therefore the face panel 1 and the weight 4 are firmly retained together (see FIGS. 6 and 6A). After the installation of the weight 4 in the center recess 13, the locating metal plate 5 is welded to the back side wall of the face panel 1 over the weight 4 in the center recess 13 to fix the weight 4 in place (see FIGS. 4, 6 and 6A).

Figure 11:
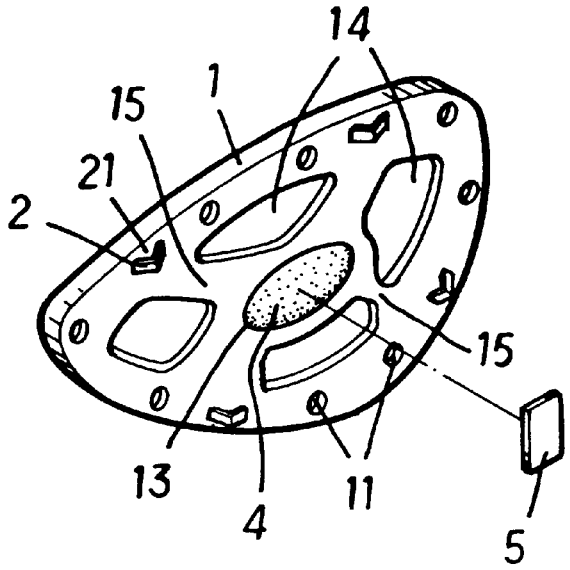
FIG. 11 is an exploded view of an alternate form of the face panel according to the present invention.
Figure 12:
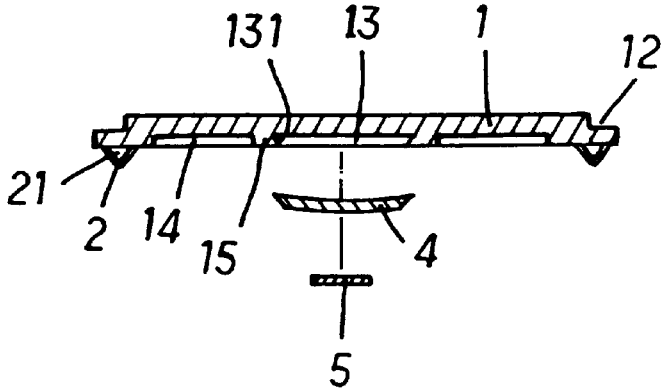
FIG. 12 is a sectional view of FIG. 11 taken from another angle.

The specific gravity of the weight 4 is higher than the face panel 1. If the face panel 1 is made of titanium or titanium alloy, tungsten or tungalloy can be used for the weight 4. Because of the effect of the weight 4, the center of gravity of the face panel 1 is concentrated at the center area. This design of golf club head enables the player to drive the ball in the desired direction relatively farther and easier. The weight 4 (the center recess 13) can have any of a variety of shapes and sizes. For example, the weight 4 can have an oval shape as shown in FIGS. 11 and 12. The design of the aforesaid peripheral recesses 14 diminishes the consumption of material. Further, the arrangement of the thick wall portions 15 reinforces the structural strength of the face panel 1, and protects the face panel 1 against distortion and cracking.

It is to be understood that the drawings are designed for purposes of illustration only, and are not intended as a definition of the limits and scope of the invention disclosed.

What the invention claimed is:

1. A golf club head comprising a face panel and a hollow casing directly molded from aluminum alloy on said face panel and covering a border area around a periphery of said face panel, wherein said face panel comprises a back recess at the center of a back side wall thereof, said back recess having a peripheral groove at a bottom side thereof, a weight mounted in said back recess, said weight filling up said peripheral groove and having a specific gravity higher than that of said face panel, and a locating metal plate welded to the back side wall of said face panel to fixedly secure said weight in place.

2. The golf club head of claim 1 wherein a plurality of V-shaped metal ribs are respectively welded to the back side wall of said face panel within said border area and embedded in said casing, said metal ribs each defining with the back side wall of said face panel a through hole, which is filled up by the aluminum alloy of said casing.

* * * * *